US005992567A

United States Patent [19]

Chiu

[11] Patent Number: 5,992,567

[45] Date of Patent: Nov. 30, 1999

[54] FOLDABLE FRAME

[76] Inventor: Ping-Jan Chiu, No. 1146, Chung-Shan Rd., Ta-Chia Chen, Taichung Hsien, Taiwan

[21] Appl. No.: 09/240,224

[22] Filed: Jan. 29, 1999

[51] Int. Cl.[6] ..... E06C 1/38

[52] U.S. Cl. ..... 182/165; 182/161

[58] Field of Search ..... 182/165, 161, 182/156, 33, 180.1; D25/65, 64

[56] References Cited

FOREIGN PATENT DOCUMENTS

| | | | |
|---|---|---|---|
| 70998 | 2/1983 | European Pat. Off. | 182/165 |
| 614971 | 12/1926 | France | 182/161 |
| 85722 | 7/1994 | Germany | 182/161 |

*Primary Examiner*—Alvin Chin-Shue
*Attorney, Agent, or Firm*—Christensen O'Connor Johnson & Kindness

[57] ABSTRACT

A foldable frame includes a pair of upright supporting rods, a pair of prop members, upper and lower crosspieces, right and left linking arms, and a pair of guiding members. The supporting rods are parallel to each other and extend in a first longitudinal direction. The prop members are also parallel to each other but extend in a second longitudinal direction. Each prop member has a second upper connecting portion pivotally connected to a first upper connecting portion of a respective supporting rod to enable the supporting rods to move from a folded position to a straddling position. The crosspieces are disposed transverse to the supporting rods, and are pivotally mounted thereon. The linking arms have upper and lower end portions respectively pivoted to rear sides of the upper and lower crosspieces, and are spaced apart from each other in a transverse direction, and are parallel to the supporting rods. The guiding members are mounted on inboard surfaces of the prop members, and are slidably coupled with the linking arms. The guiding members are guide movement of the linking arms relative thereto so as to bring the upper crosspiece to be seated on the guiding members when the prop members are in the straddling position.

1 Claim, 8 Drawing Sheets

FOLDABLE FRAME

BACKGROUND OF THE INVENTION

1. Field of the Invention

The invention relates to a foldable frame, more particularly to a foldable ladder or chair that is safe to manipulate and use.

2. Description of the Related Art

As working and living spaces become more and more limited nowadays, household items tend to be collapsible or movable so as to occupy less space.

With reference to FIGS. 1 and 2, a conventional foldable frame 10, such as a foldable ladder or chair, is shown to include a pair of upright supporting rods 11, a pair of prop members 12 pivotally connected to the supporting rods 11, at least one crosspiece 13 having one side pivotally mounted on the upright supporting rods 11, a crossbar 14 disposed near a top section of the prop members 12, at least one link 15 connected to the other side of each crosspiece 13, and a retaining link 16 provided on a bottom face of an uppermost one of the crosspieces 13 to be coupled pivotally with the crossbar 14 in a linking-up relationship. Due to the above-mentioned linkage structure, by moving a rear side of the uppermost crosspiece 13, the prop members 12 are caused to move towards or away from the upright supporting rods 11. At this time, the other crosspieces 13 are caused to turn simultaneously to allow the opening or closing of the frame 10. However, although the frame 10 is easy to stow, it suffers from the following drawbacks in use:

Since the linking-up movement of the upright supporting rods 11, the prop members 12, and the crosspieces 13 is achieved by means of the pivotal connections or the links 15 and the retaining link 16, movement of any one of the crosspieces 13 will bring the other structural elements to move therewith. Although a construction as such affords convenience in terms of opening and closing of the frame 10, as the crosspieces 13 have only one side pivotally connected to the upright supporting rods 11 and are without any means to position the same, if the distribution of weight on any one of the crosspieces 13 is concentrated at the pivoted side, or if any one of the crosspieces 13 was bumped into inadvertently, all of the crosspieces 13 will henceforth turn, thereby resulting in abrupt folding of the frame 10, which may cause danger to the user or anyone nearby.

SUMMARY OF THE INVENTION

Therefore, the main object of the present invention is to provide a foldable frame that can prevent accidental folding thereof.

Accordingly, a foldable frame according to the present invention comprises a pair of upright supporting rods, a pair of prop members, upper and lower crosspieces, right and left linking arms, and a pair of guiding members. The upright supporting rods are disposed parallel to each other and extend in a first longitudinal direction. Each upright supporting rod has a first upper connecting portion, a first lower leg portion, and a first intermediate portion disposed between the first upper connecting portion and the first lower leg portion. The prop members are disposed parallel to each other and extend in a second longitudinal direction. Each prop member has a second upper connecting portion, a second lower leg portion, and a second intermediate portion disposed between the second upper connecting portion and the second lower leg portion. The second upper connecting portion of each prop member is pivotally connected to the first upper connecting portion of a respective upright supporting rod about a first axis to enable a movement from a folded position where the first lower leg portion is closer to the second lower leg portion, to a straddling position where the first lower leg portion is remote from the second lower leg portion. Each of the upper and lower crosspieces has a major surface with front and rear sides opposite to each other. The front side of each crosspiece is disposed transverse to and between the first intermediate portions of the upright supporting rods. The front sides of the crosspieces are mounted pivotally on the upright supporting rods about one of second and third axes. The second and third axes are parallel to each other and are disposed proximate to the first upper connecting portions and the first lower leg portions of the upright supporting rods, respectively. Each of the right and left linking arms has upper and lower end portions respectively pivoted to the rear sides of the upper and lower crosspieces about one of fourth and fifth axes that are parallel to each other. The right and left linking arms are spaced apart from each other in a transverse direction relative to the first longitudinal direction, and are disposed parallel to the upright supporting rods. The guiding members are mounted respectively on inboard surfaces of the second intermediate portions of the prop members, and are slidably coupled to one of the right and left linking arms. The guiding members guide movement of the right and left linking arms relative thereto so as to bring the rear side of the upper crosspiece to be seated on the guiding members when the prop members are in the straddling position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
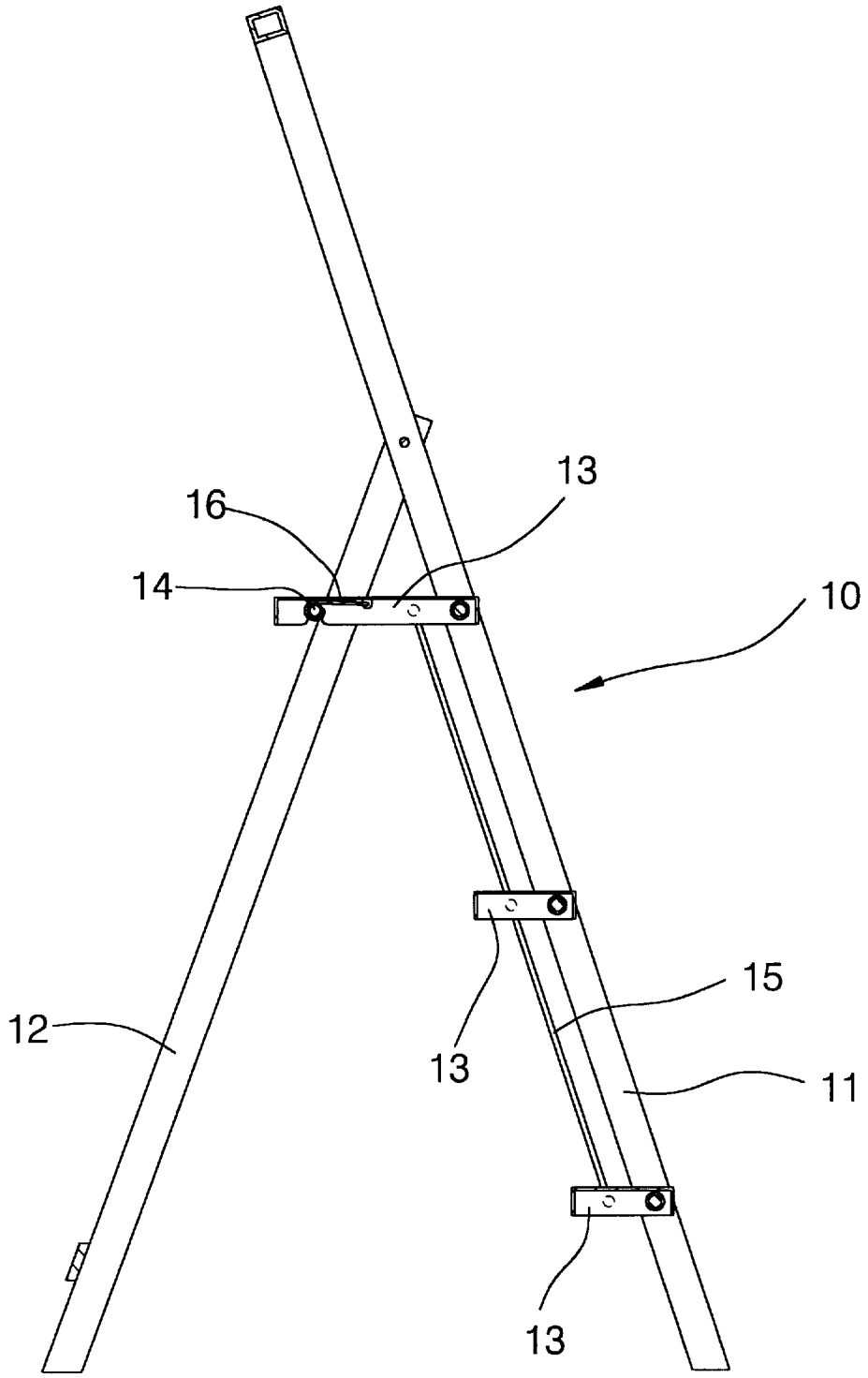
FIG. 1 PRIOR ART
FIG. 1 is a schematic view of a foldable frame of the prior art.
Figure 2:
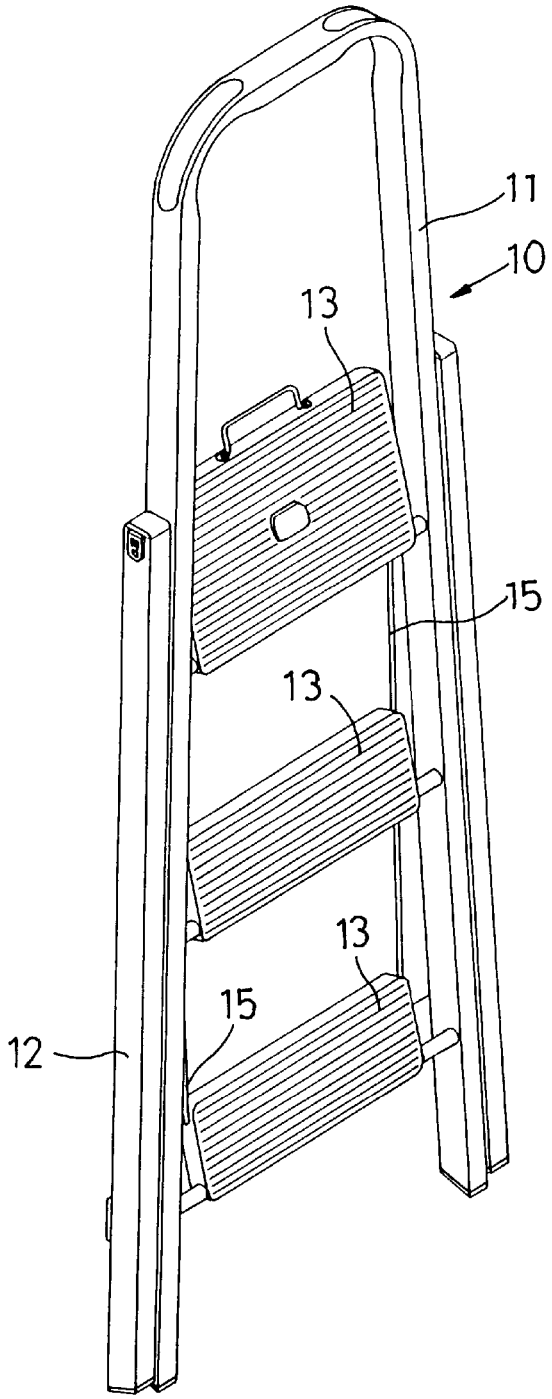
FIG. 2 PRIOR ART
FIG. 2 is a perspective view illustrating the frame of FIG. 1 in a folded state.
Figure 3:
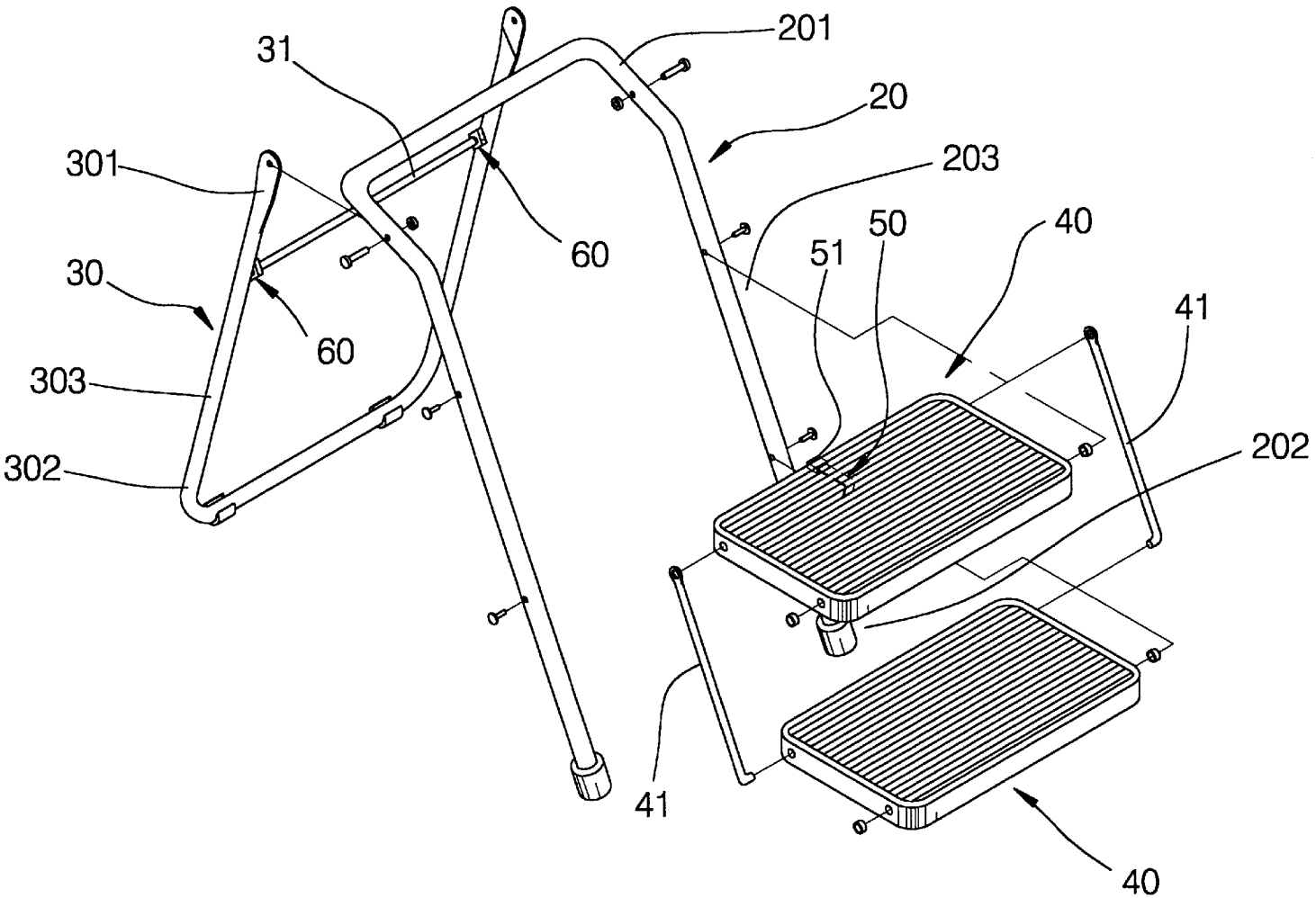
FIG. 3 is an exploded perspective view of a preferred embodiment of a foldable frame according to the present invention.

Referring to FIG. 3, the preferred embodiment of the foldable frame according to the present invention is shown to include a pair of upright supporting rods 20, a pair of prop members 30 pivotally connected to the upright supporting rods 20, upper and lower crosspieces 40, right and left linking arms 41, and a pair of guiding members 60. The upright supporting rods 20 are disposed parallel to each other and extend in a first longitudinal direction. Each of the upright supporting rods 20 has a first upper connecting portion 201, a first lower leg portion 202, and a first intermediate portion 203 disposed between the first upper connecting portion 201 and the first lower leg portion 202.

The prop members 30 are disposed parallel to each other and extend in a second longitudinal direction. Each of the prop members 30 has a second upper connecting portion 301, a second lower leg portion 302, and a second intermediate portion 303 disposed between the second connecting portion 301 and the second lower leg portion 302. The second upper connecting portions 301 of the prop members 30 are pivotally connected to the first upper connecting portions 201 of the upright supporting rods 20 about a first axis (L) to enable a movement from a folded position where the first lower leg portions 201 of the upright supporting rods 20 are closer to the second lower leg portions 302 of the prop members 30, to a straddling position where the first lower leg portions 202 are remote from the second lower leg portions 302 (see FIG. 5).

Figure 5:
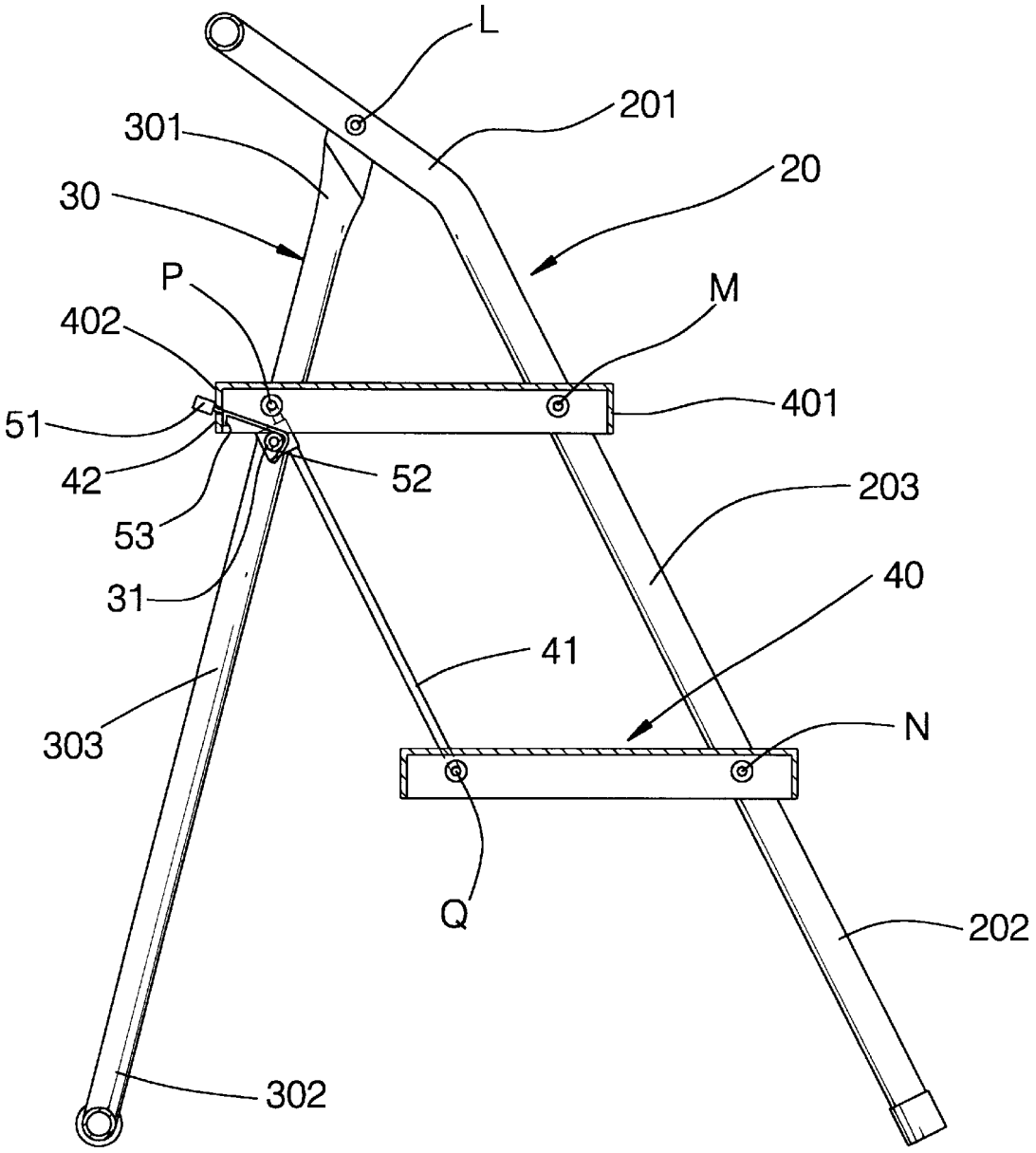
FIG. 5 is a schematic view of the preferred embodiment.
Figure 6:
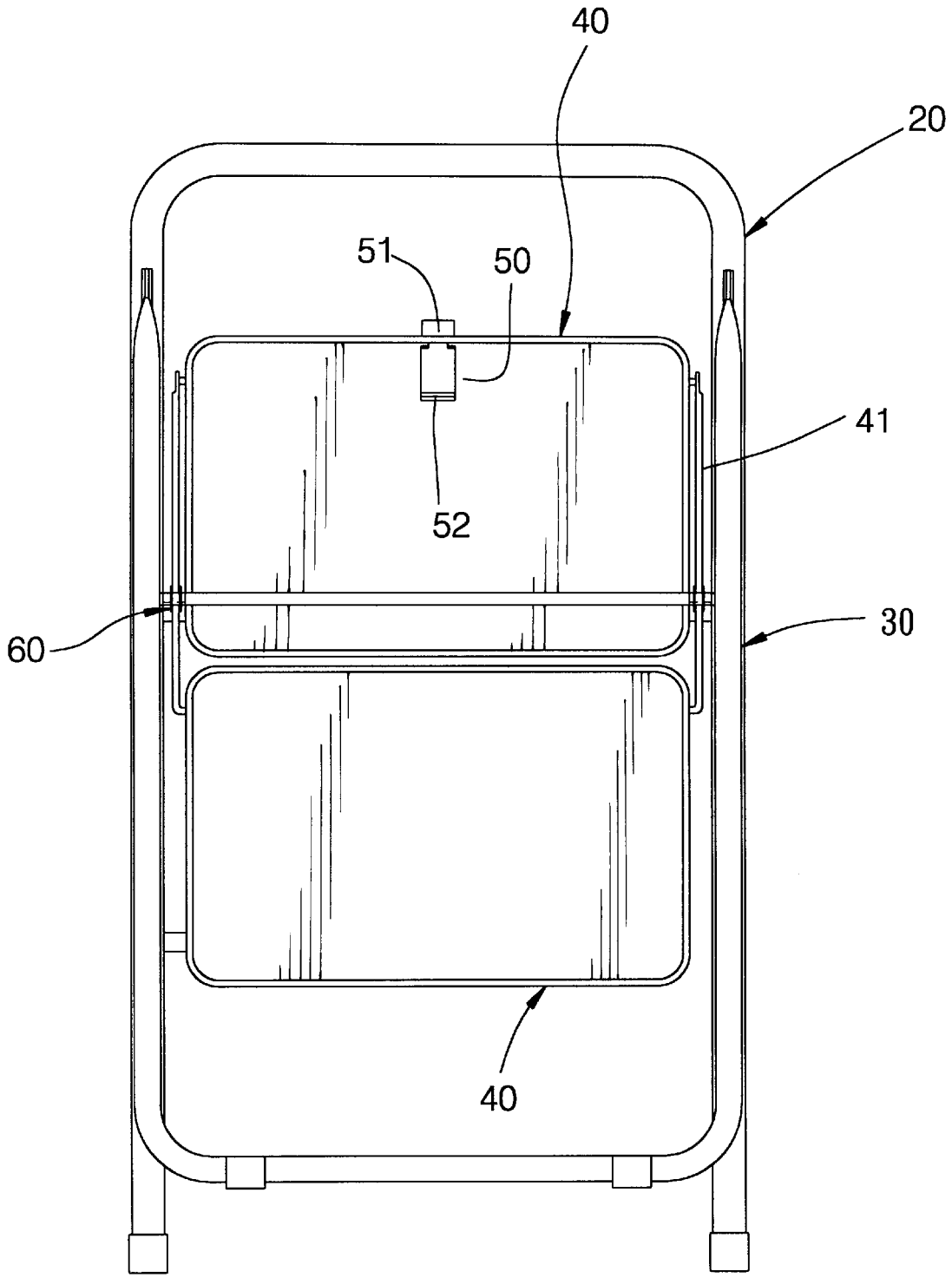
FIG. 6 is a rear view of the preferred embodiment, showing the frame in a folded state.

Each of the upper and lower crosspieces 40 has a major surface with front and rear sides 401, 402 opposite to each other (see FIG. 5). The front sides 401 of the crosspieces 40 are disposed transverse to and are disposed between the first intermediate portion 203 of the upright supporting rods 20 about a respective one of second and third axes (M), (N), which are parallel to each other. The second and third axes (M), (N) are disposed proximate to the first upper connecting portions 201 and the first lower leg portions 202 of the upright supporting rods 20, respectively.

Each of the right and left linking arms 41 has upper and lower end portions respectively pivoted to the rear sides 402 of the upper and lower crosspieces 40 about a respective one of fourth and fifth axes (P), (Q), which are parallel to each other (see FIG. 5). The right and left linking arms 41 are spaced apart from each other in a transverse direction relative to the first longitudinal direction and are disposed parallel to the upright supporting rods 20.

The guiding members 60 are mounted respectively on inboard surfaces of the second intermediate portions 303 of the prop members 30, and are coupled slidably to and guide movement of a respective one of the right and left linking arms 41 relative thereto so as to bring the rear side 402 of the upper crosspiece 40 to be seated on the guiding members 60 when the prop members 30 are in the straddling position.

As shown in FIG. 5, the upper crosspiece 40 includes a flange portion 42 that extends downwardly from the rear side 402 thereof, and that is spaced apart from the fourth axis (P). The foldable frame further includes an anchored crossbar 31 and a lever 50.

The anchored crossbar 31 interconnects the guiding members 60 and is transverse to the second longitudinal direction.

Figure 4A:
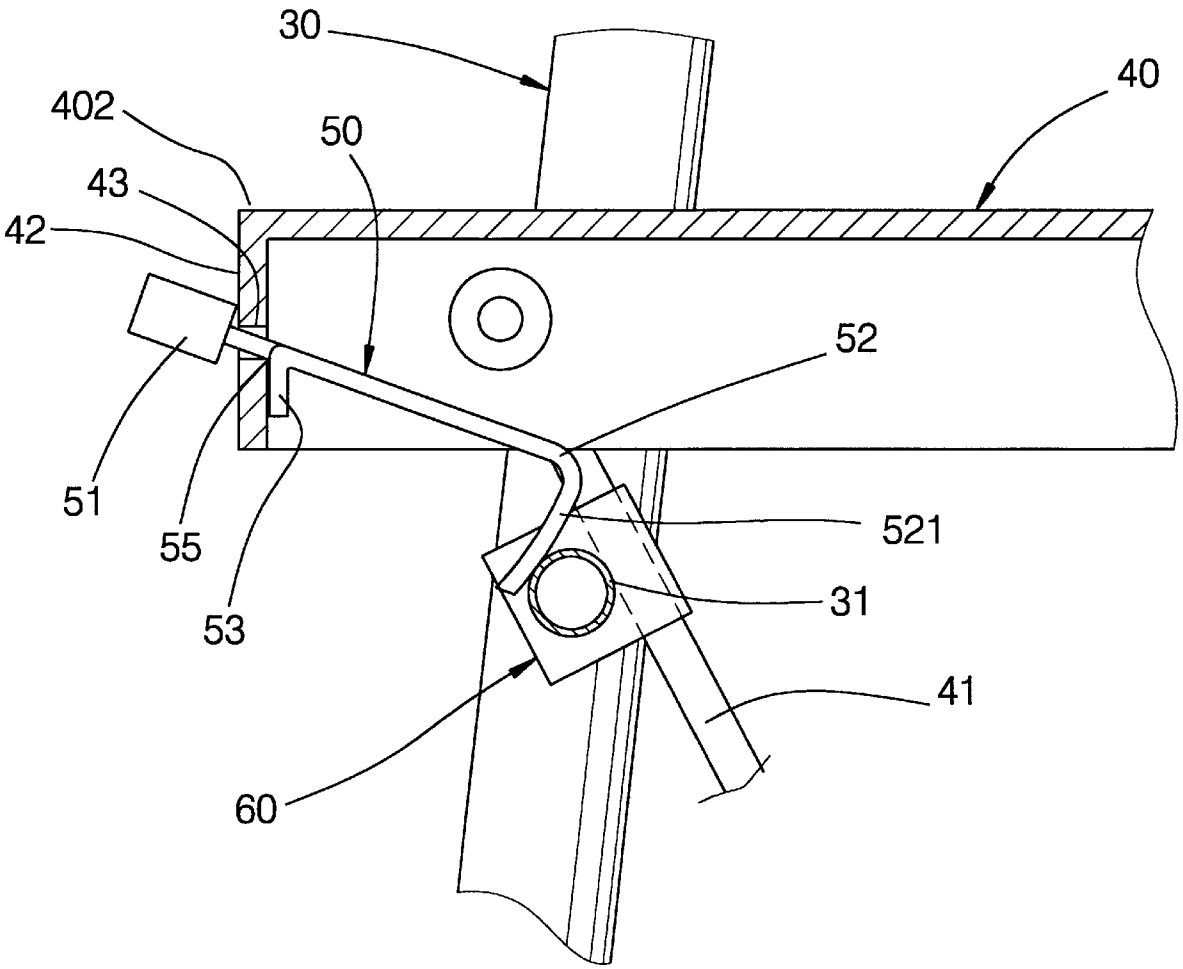
FIGS. 4A, 4B and 4C are sectional views illustrating operation of a lever and an anchored crossbar of the preferred embodiment.
Figure 4B:
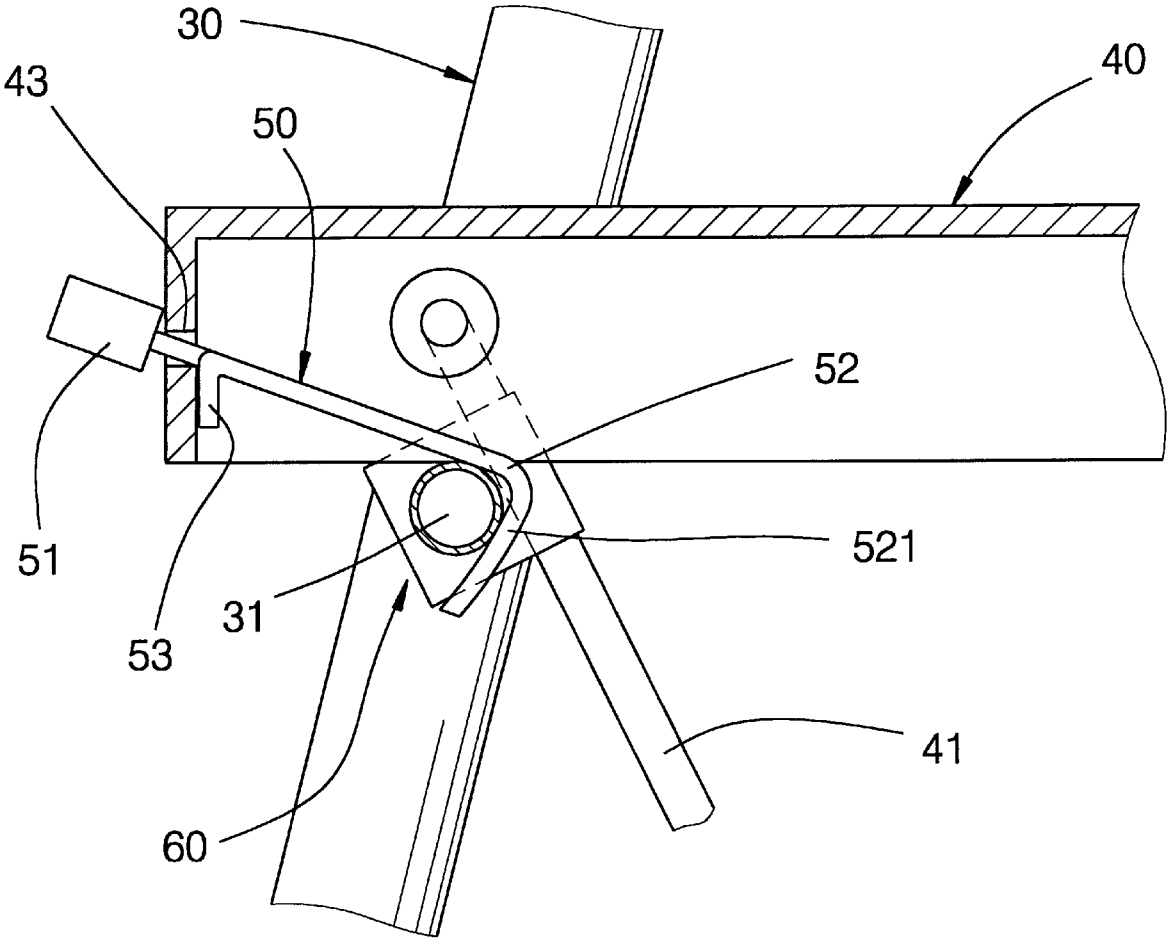
Figure 4C:
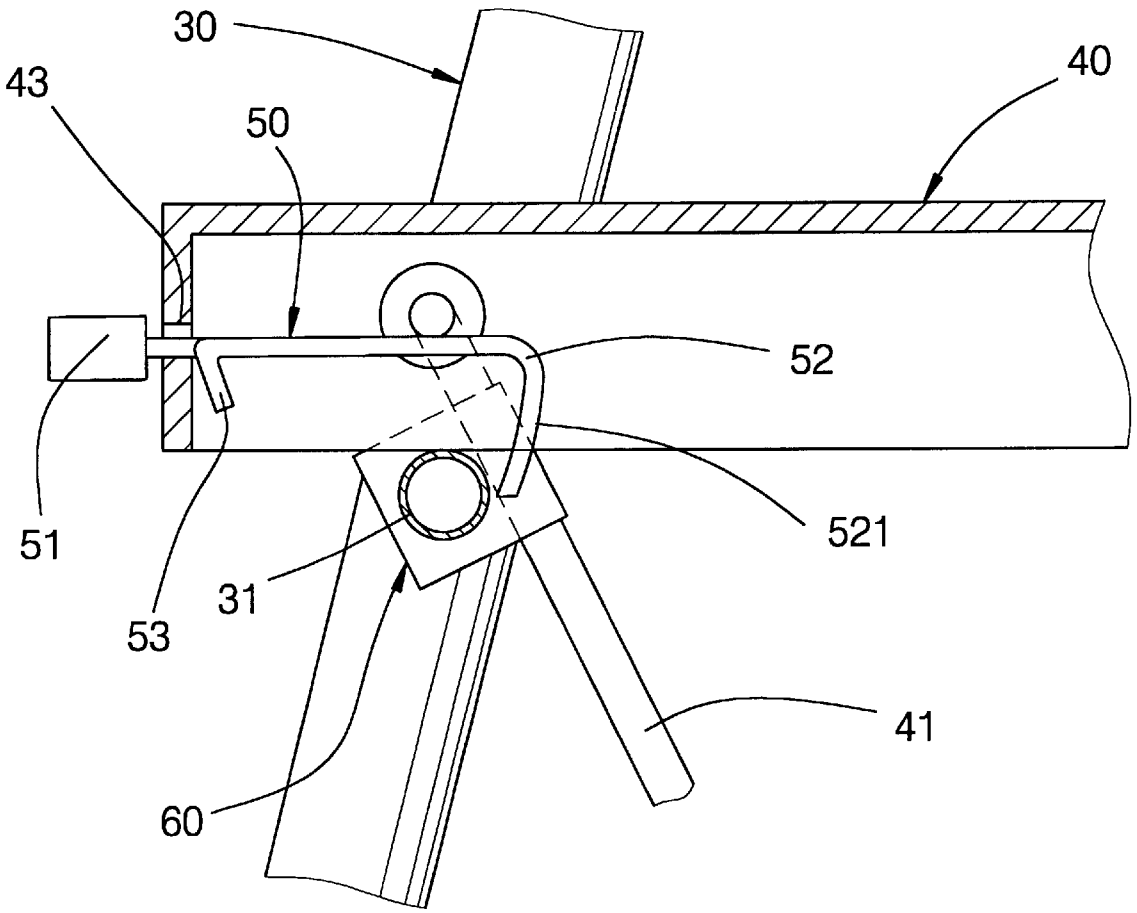

Referring to FIG. 4A, the lever 50 is disposed under the upper crosspiece 40, and has a fulcrum 55, an anchoring end 52, an actuating end 51, and a biasing member 53. The fulcrum 55 is supported on the flange portion 42 of the upper crosspiece 40 and can be turned about a turning axis parallel to the fourth axis (P). The flange portion 42 is formed with an opening 43 through which the lever 50 can extend. The anchoring end 52 and the actuating end 51 are disposed on opposite sides of the fulcrum 55. The actuating end 51 extends rearwardly and outwardly of the flange portion 42 so as to actuated manually. The anchoring end 52 extends towards the front side 401 of the upper crosspiece 40 so as to be brought to hook on the anchored crossbar 31. The anchoring end 52 has an outer curved face 521. The biasing member 53 is disposed to bias the anchoring end 52 to turn in a direction which will bring the anchoring end 52 to hook on the anchored crossbar 31. In addition, the biasing member 53 is provided to retain the lever 50 within the opening 43.

With reference to FIGS. 4A, 4B, 4C, 5 and 6, in use, by pulling slightly the rear side 402 of one of the crosspieces 40, the upper and lower crosspieces 40 are caused to turn simultaneously due to the provision of the linking arms 41. At this point, the curved face 521 of the anchoring end 52 of the lever 50 follows the turning of the upper and lower crosspieces 40 to abut against the anchored crossbar 31. Also, with the turning of the upper and lower crosspieces 40, and during the sliding displacement of the linking arms 41 in the guiding members 60, the guiding members 60 cause the prop members 30 to extend away from the upright support rods 20. Then, the curved face 521 of the anchoring end 52 of the lever 50 ceases to abut against the anchored crossbar 31, and the anchoring end 52 is brought to hook on the anchored crossbar 31. Hence, the upper and lower crosspieces 40, and the anchored crossbar 31 of the prop members 30 can be positioned to prohibit inadvertent folding of the frame, and can limit the angle of extension between the prop members 30 and the upright supporting rods 20.

When it is desired to fold up the frame according to the present invention, it is only necessary to press the actuating end 51 of the lever 50 slightly. Because of the lever principle, the anchoring end 52 of the lever 50 will disengage from the anchored crossbar 31 of the prop members 30. At this time, by pulling the upper crosspiece 40 upward, the upper crosspiece 40 will turn towards the prop members 30, thereby bringing the lower crosspiece 40 to turn therewith. At the same time, by means of the linking arms 41 that are linked up with the guiding members 60, the guiding members 60 can, during the sliding displacement of the linking arms 41, pull the prop members 30 to move towards the upright supporting rods 20 so that the upright supporting rods 20, the prop members 30, and the upper and lower crosspieces 40 are substantially brought into alignment with one another in a folded state.

The foldable frame of the present invention as described above has the advantage that, when the upright supporting rods 20 and the prop members 30 are in a straddling position with the upper and lower crosspieces 40 in a level position, inadvertent folding thereof is prevented by the anchoring end 52 of the lever 50 that engages the anchored crossbar 31 even when the distribution of load on the crosspieces 40 is uneven or when the crosspieces 40 are bumped into accidentally. More importantly, during folding of the foldable frame of the present invention, the actuating end 51 of the lever 50 must be pressed first to cause the anchoring end 52 to disengage from the anchored crossbar 31. It can therefore be appreciated that the present invention ensures that the frame of the present invention will not be folded abruptly, thus preventing possible accidents.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable frame comprising:

a pair of upright supporting rods disposed parallel to each other and extending in a first longitudinal direction, each having a first upper connecting portion, a first lower leg portion, and a first intermediate portion disposed between said first upper connecting portion and said first lower leg portion;

a pair of prop members disposed parallel to each other and extending in a second longitudinal direction, each having a second upper connecting portion, a second lower leg portion, and a second intermediate portion disposed between said second upper connecting portion and said second lower leg portion, said second upper connecting portion of each of said prop members being pivotally connected to said first upper connecting portion of a respective one of said upright supporting rods about a first axis to enable movement from a folded position where said first lower leg portion is closer to said second lower leg portion, to a straddling position where said first lower leg portion is remote from said second lower leg portion;

upper and lower crosspieces each with a major surface having front and rear sides opposite each other, said front side of each of said upper and lower crosspieces being disposed transverse to and being disposed between said first intermediate portions of said pair of upright supporting rods, said front sides of said upper and lower crosspieces being mounted pivotally on said pair of upright supporting rods about a respective one of second and third axes, which are parallel to each other, said second and third axes being disposed proximate to said first upper connecting portions and said first lower leg portions of said pair of upright supporting rods, respectively right and left linking arms each having upper and lower end portions, respectively pivoted to said rear sides of said upper and lower crosspieces about a respective one of fourth and fifth axes, which are parallel to each other, said right and left linking arms being spaced apart from each other in a transverse direction relative to said first longitudinal direction, and being disposed parallel to said pair of upright supporting rods; and a pair of guiding members mounted on inboard surfaces of said second intermediate portions of said prop members, respectively, said guiding members being slidably coupled to and guiding movement of a respective one of said right and left linking arms relative thereto, so as to bring said rear side of said upper crosspiece to be seated on said pair of guiding members when said prop members are in said straddling position;

wherein said upper crosspiece includes a flange portion extending downwardly from said rear side thereof and spaced apart from said fourth axis, said frame further comprising an anchored crossbar interconnecting said pair of guiding members and transverse to said second longitudinal direction, and a lever disposed under said upper crosspiece, said lever having a fulcrum supported on said flange portion and being turnable about a turning axis parallel to said fourth axis, said lever having an anchoring end and an actuating end, respectively, disposed at opposite sides of said fulcrum, said anchoring end extending toward said front side so as to be hooked on said anchored crossbar, said actuating end extending rearwardly and outwardly of said flange portion so as to be capable of being actuated manually, said lever further having a biasing member disposed to bias said anchoring end to turn in a direction causing said anchoring end to be hooked on said anchored crossbar.

* * * * *

UNITED STATES PATENT AND TRADEMARK OFFICE

CERTIFICATE OF CORRECTION

PATENT NO. : 5,992,567
DATED : November 30, 1999
INVENTOR(S) : P.-J. Chiu

It is certified that error appears in the above-identified patent and that said Letters Patent is hereby corrected as shown below:

Column 5,
Line 25 (Claim 1, line 43), after "respectively" insert -- ; --
Line 27 (Caim 1, line 36), after "respectively" insert -- , --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*